United States Patent [19]

Goto et al.

[11] 4,114,576

[45] Sep. 19, 1978

[54] EXHAUST GAS RECIRCULATING CONTROL SYSTEM

[75] Inventors: Mikio Goto; Mitsunori Sasano, both of Toyota; Koichi Oosawa, Susono; Mitsuya Yoshihara, Nagoya, all of Japan

[73] Assignees: Toyota Jidosha Kogyo Kabushiki Kaisha; Aisan Kogyo Kabushiki Kaisha, both of Japan

[21] Appl. No.: 750,185

[22] Filed: Dec. 13, 1976

[30] Foreign Application Priority Data

Jun. 9, 1976 [JP] Japan ..... 51-75632[U]

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,739,797 | 6/1973 | Caldwell | 123/119 A |
| 3,768,452 | 10/1973 | Lewis | 123/119 A |
| 3,884,200 | 5/1975 | Caldwell | 123/119 A |
| 3,885,536 | 5/1975 | Marshall | 123/119 A |
| 3,962,868 | 6/1976 | Matumoto | 123/119 A |
| 3,992,878 | 11/1976 | Moorman | 123/119 A |
| 3,994,269 | 11/1976 | Takaoka | 123/119 A |
| 4,026,168 | 5/1977 | Kobayashi | 123/97 B |
| 4,031,871 | 6/1977 | Hamanishi | 123/119 A |
| 4,040,402 | 8/1977 | Nohira | 123/119 A |
| 4,041,915 | 8/1977 | Konishi | 123/119 A |

*Primary Examiner*—Wendell E. Burns
*Attorney, Agent, or Firm*—Koda and Androlia

[57] ABSTRACT

An exhaust gas recirculating control system for internal combustion engines including an engine vacuum operated exhaust gas recirculating valve which allows recirculation of the engine exhaust when a high vacuum is applied, an engine vacuum operated vacuum control valve which allows air pressure to be applied to the exhaust gas recirculation valve when the engine vacuum exceeds a predetermined level, and a vacuum transmitting valve which delays in time the application of engine vacuum to the vacuum control valve. In this way, exhaust gas recirculation occurs during a fixed period after acceleration of the vehicle occurs.

5 Claims, 1 Drawing Figure

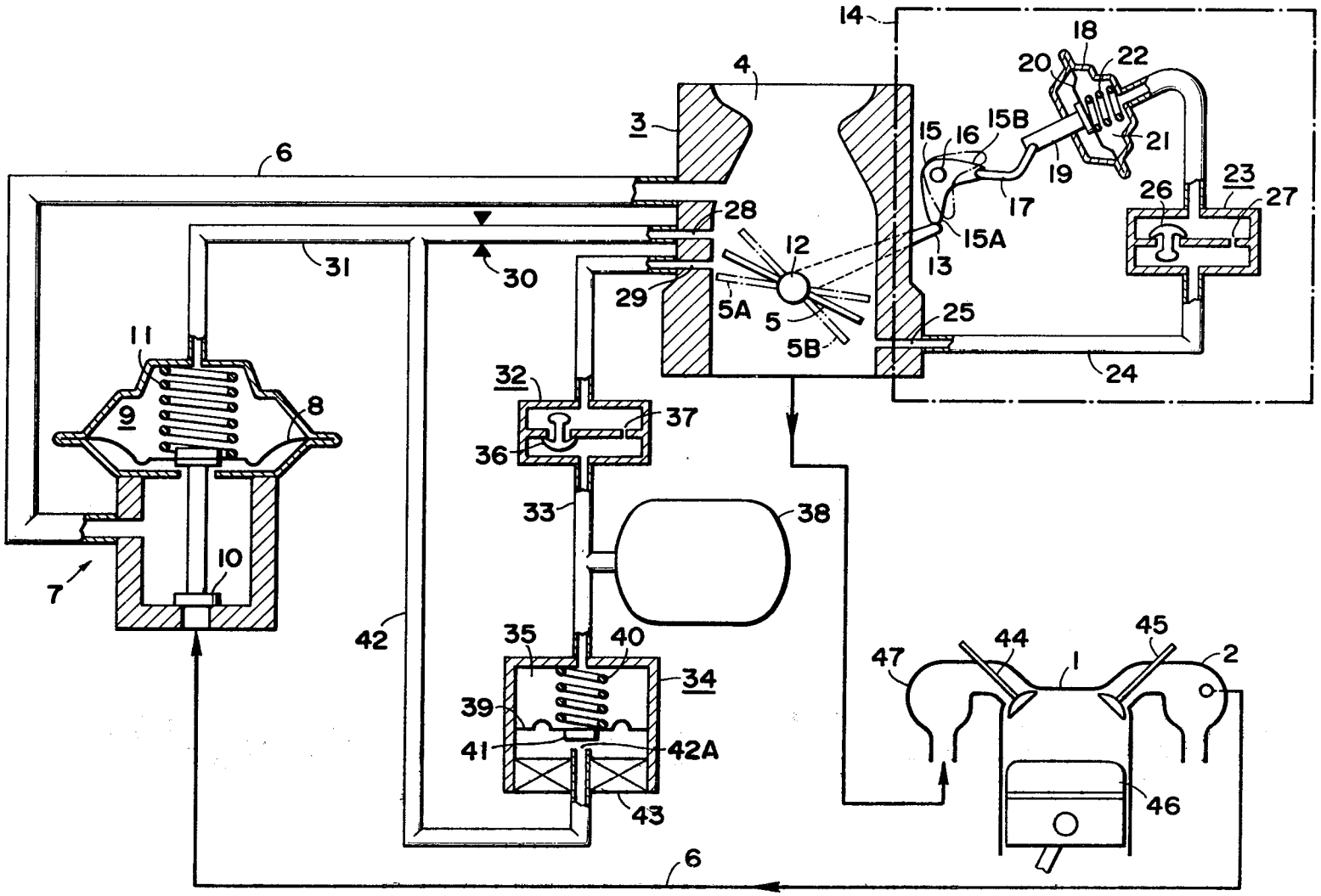
27
23
26
22
21
18
20
19
17
15B
16
15A
15
13
25
24
14
12
5
5B
5A
4
28
3
29
30
31
6
8
9
10
11
7
37
32
36
33
38
34
42A
40
43
35
39
41
42
2
45
46
1
44
47

EXHAUST GAS RECIRCULATING CONTROL SYSTEM

BACKGROUND OF THE INVENTION

1. Field of Invention

This invention relates to pollution control systems for internal combustion engines and more particularly to pollution control systems which utilize exhaust gas recirculation.

2. Prior Art

Since the amount of $NO_x$ emitted during acceleration of an internal combustion is great and the amount emitted during cruising speeds is small, the reduction effect of exhaust gas recirculation (hereinafter referred to as EGR) on the $NO_x$ contained in the engine exhaust gases is greatest during acceleration and only slight during cruising.

Since EGR generally has an adverse effect upon automobile performance and increases fuel costs, it is desirable that EGR be allowed to operate only during acceleration when the $NO_x$ reduction effect is greatest and that deterioration of performance be avoided during cruising speeds when the effect of EGR is slight.

In the prior art there exists several different systems which utilize exhaust gas recirculation, but these systems typically are exceedingly complex and utilize a myriad of vacuum operated valves, electromechanical valves, electronic sensors, etc. Besides their complexity, the prior art systems also operate with varying degrees of success and none has been found to be completely satisfactory and almost all cause some deterioration in engine performance.

SUMMARY OF THE INVENTION

Accordingly, it is the general object of the present invention to provide an exhaust gas recirculation system which allows EGR during a designated time period following acceleration of the internal combustion engines.

It is another object of the present invention to provide an exhaust gas recirculation control system which is simple and inexpensive.

In keeping with the principles of the present invention, the objects are accomplished by a unique exhaust gas recirculation control system which includes an engine vacuum operated exhaust gas recirculation valve which opens and closes the exhaust gas recirculation line which recycles the engine exhaust gases to the air intake side of the engine, a primary vacuum port which is adjacent to the throttle valve and which opens into the carburator air intake at a point upstream from said valve, a primary vacuum line which connects the primary vacuum port with the exhaust gas recirculation valve, a restriction in the primary vacuum line, a secondary vacuum port which opens into the carburator air intake at a point downstream from the primary vacuum port but upstream from the throttle valve, a vacuum operated control valve which allows air pressure to be applied to the exhaust gas recirculation valve when the vacuum applied to the vacuum operated control valve exceeds a given level, a secondary vacuum line which connects the vacuum control valve with the secondary vacuum port and a vacuum transmitting valve, provided with a check valve and adjacent orifice, which allows the flow of vacuum in only one direction from the secondary vacuum port towards the vacuum operated control valve and which delays in the time the application of vacuum to the vacuum operated control valve. In this way, exhaust gas recirculation only occurs during a fixed period after acceleration of the vehicle.

BRIEF DESCRIPTION OF THE DRAWINGS

The above mentioned and other features not obvious to the present invention will become more apparent by reference to the following description taken in conjunction with the accompanying drawings, wherein like reference numerals denote like elements and in which:

The FIGURE is a cross-sectional view of an exhaust gas control system in accordance with the teachings of the present invention.

DETAILED DESCRIPTION OF THE INVENTION

Referring more specifically to the drawings, in the FIGURE is shown an exhaust gas recirculation system in accordance with the teachings of the present invention. In the exhaust gas recirculation system of the FIGURE, the one end of the EGR line 6 is connected to the exhaust manifold 2 of the internal combustion engine 1. The other end of the EGR line 6 is connected to the air intake 4 of carburator 3 at a point upstream from throttle valve 5. EGR valve 7 is provided between manifold 2 and air intake 4 in the EGR line 6 and actuates so as to open and close the EGR line 6.

The EGR valve 7 includes an external housing, a diaphram 8 mounted in the housing, a vacuum chamber 9 which is formed by a portion of the housing and diaphram 8, a valve 10 which is coupled to and moves with diaphram 8 and a spring 11 located in the vacuum chamber 9 which biases the diaphram 8 in a direction of expansion of the vacuum chamber 9 and which via the diaphram 8 causes valve 10 to move in such a direction that the EGR line 6 is closed.

Throttle lever 13 is coupled to throttle shaft 12 and is supported so that it can pivot on the external end of throttle shaft 12 of throttle valve 5. Throttle lever 13 is provided adjacent one end 15A of stopper 15 of throttle positioner (hereinafter referred to as TP) mechanism 14. During deceleration, the throttle lever 13 contacts the end 15A of the stopper 15 so that the throttle valve 5 stops in a position (hereinafter referred to as the TP position) slightly more open than the idle position. In this way, the closing of the throttle valve 5 to the idle position is regulated. Stopper 15 is pivotally supported on pivot pin 16. The other end 15B of stopper 15 is connected to one end of link 17. The other end of link 17 is connected to the tip of rod 19 of the throttle positioner 18. The throttle positioner 18 includes a housing, a diaphram 20 which divides the housing, a vacuum chamber formed between the diaphram and the housing and located on the opposite side of diaphram 20 from rod 19, and a spring 22 which biases the diaphram 20 in a direction of expansion of the vacuum chamber 21. Rod 19 is coupled to diaphram 20.

Vacuum chamber 21 is coupled to a vacuum port 25 by a vacuum line 24 which is provided with a vacuum transmitting valve (hereinafter referred to as VTV) 23 located in vacuum line 24. The vacuum port 25 opens into the air intake 4 at a point downstream from the throttle valve 5. The VTV 23 contains a check valve 26 which allows a flow of vacuum in one direction only from the port 25 towards the vacuum chamber 21 and an orifice 27 which is located adjacent to the check valve 26.

Primary and secondary vacuum ports 28 and 29 are provided in air intake 4 of carburator 3. The primary vacuum port 28 is provided at a point slightly upstream from the tip of the throttle valve 5 when the valve 5 is in the TP position. The secondary vacuum port 29 is provided at a point downstream from the TP position and upstream from the idle position (indicated by the broken line 5A in the figure) of throttle valve 5.

The primary vacuum port 28 is coupled to vacuum chamber 9 of EGR valve 7 by primary vacuum line 31 which contains a restriction 30. Furthermore, the secondary vacuum port 29 is coupled to vacuum chamber 35 of vacuum control valve 34 by a secondary vacuum line 33 which has a VTV 32 provided therein.

VTV 32 contains a check valve 36 which allows the flow of vacuum in one direction only, from the port 29 towards the vacuum chamber 35, and an orifice 37 which is located adjacent to and parallel with the check valve. Furthermore, a vacuum surging tank 38 is coupled to the vacuum line 33 at a point between the VTV and the vacuum control valve 34.

Vacuum control valve (hereinafter referred to as VCV) 34 is provided with a diaphram 39 which forms a vacuum chamber 35, a spring 40 provided within the vacuum chamber 35 which biases the diaphram 39 in the direction of expansion of the vacuum chamber 35 and a valve 41 which is coupled to the diaphram 9. When the vacuum level inside the vacuum chamber 35 decreases, the valve 41 is pushed along with the diaphram 39 in the direction of expansion of the vacuum chamber 35 and closes off the terminal opening 42A of line 42. When the vacuum level applied to vacuum chamber 35 is above a given value, valve 41 opens line 42 which allows air to flow through air filter 43 into line 42. The other end of line 42 is connected with primary vacuum line 31 at a point between the restriction 30 and the vacuum chamber 9 of EGR valve 7. Furthermore, in the figures, 47 indicates the intake manifold, 44 is the intake valve, 45 is the exhaust valve and 46 indicates the piston, all of which are components of engine 1.

In operation, initially when the engine is idling, the throttle valve 5 is in the position indicated by the broken line 5A. Therefore, both vacuum ports 28 and 29 are upstream from throttle valve 5 and there is no vacuum applied thereto. Accordingly, valve 10 of EGR valve 7 is driven in the direction of expansion of vacuum chamber 9 and closes off the EGR line 6 and prevents the recirculation of exhaust gases. In this situation, since vacuum is transmitted from port 25 to vacuum chamber 21 of TP 18, diaphram 20 via rod 19 and link 17 pulls the stopper 15 so that it swings into the position indicated by the broken lines in the figure. Hence, the throttle lever 13 and the throttle valve 5 are free from the regulation of stopper 15. Furthermore, VCV 34 is closed.

When the vehicle is accelerated by accelerating the internal combustion engine 1, throttle valve 5 is moved into a position upstream from ports 28 and 29 as indicated by a broken line 5B. Accordingly, vacuum operates upon the ports 28 and 29 and is transmitted to the vacuum chamber 9 of EGR valve 7. The vacuum also tries to reach vacuum chamber 35 of VCV 34, but there is a fixed time lag in the transmission of the vacuum through vacuum line 33 caused by vacuum surging tank 38 and the orifice 37 of VTV 32.

Accordingly, VCV 34 remains closed for a fixed period of time after the acceleration has begun. Therefore, during this period, the vacuum in vacuum chamber 9 of EGR valve 7 is maintained by the vacuum operated upon vacuum port 28. As long as the value of the vacuum in vacuum chamber 9 is greater than that of the line 6, valve 10 keeps the EGR line 6 open and EGR occurs. After the passage of a fixed period of time, VCV 34 is opened by the vacuum applied to port 29 and air is permitted to flow into vacuum chamber 9 of EGR valve 7 through lines 42 and 31 from the opening 42A. Accordingly, EGR valve 7 is closed and EGR is stopped. A large inflow of air into air intake 4 is prevented by the restriction 30 which also helps maintain the vacuum in vacuum line 31 safely below the level required to open EGR valve 7.

When the internal combustion engine 1 is decelerated, the throttle valve is ordinarily maintained in the TP position by the action of the TP mechanism 14 and is not allowed to immediately close as far as the idle position. Accordingly, vacuum operates on port 29 and the vacuum in vacuum chamber 35 either is maintained or continues to increase. Hence, EGR is either turned off within a short period of time or is kept off, whichever the case may be. Meanwhile, since the vacuum port 28 is upstream from throttle valve 5 in the TP position, the vacuum does not operate on the EGR valve 7 and the EGR valve 7 is kept off independent of the EGR on/off effect of VCV 34.

When the throttle valve 5 has returned to the idle position, the post acceleration EGR of fixed duration described above has been accomplished.

In the preceding embodiment, a vacuum surging tank 38 is connected to the secondary vacuum line 33. However, if the volume of space between the orifice 37 and the vacuum chamber 35 is sufficient, the vacuum surging tank 38 may be omitted. Furthermore, the air admitting line 42 may be designed so that it can admit air directly into vacuum chamber 9 of EGR valve 7 and the line 42 may be directly connected to vacuum chamber 9.

It should be apparent that this invention is able to control exhaust gas recirculation so that it occurs only during fixed periods of time after acceleration of the automobile occurs and is very effectively designed to prevent both increased fuel cost and deterioration of driveability during cruising speeds when the $NO_x$ reduction effect is slight.

In all cases it is understood that the above described embodiments are merely illustrative of but a small number of the many possible specific embodiments which can represent applications of the principles of the present invention. Numerious and varied other arrangements can be readily devised in accordance with these principles by those skilled in the art without departing from the spirit and scope of the invention.

I claim:

1. An exhaust gas recirculating control system for an internal combustion engine comprising:

a means for recirculating exhaust gas from an exhaust manifold to an air intake of said internal combustion engine whenever a vacuum exists in said air intake;

a means for applying air pressure to said recirculating means instead of a vacuum whenever a vacuum exists in said air intake of a predetermined magnitude; and a means for delaying operation of said air pressure applying means for a predetermined time interval whereby exhaust gas recirculation is allowed for some predetermined time after acceleration of said internal combustion engine occurs.

2. An exhaust gas recirculating control system for an internal combustion engine comprising:

an exhaust gas recirculation line from an exhaust manifold of said internal combustion engine to an air intake of said internal combustion engine, said exhaust gas recirculation line entering said air intake upstream from an idle position of a throttle valve in said air intake;

an engine vacuum operated exhaust recirculating valve inserted in said exhaust gas recirculating line, said exhaust gas recirculating valve having a vacuum chamber, said exhaust gas recirculating valve opening said exhaust gas recirculating line when a vacuum is applied to said vacuum chamber;

a primary vacuum port in said air intake upstream from an idle position of said throttle valve, said primary vacuum port being adjacent said throttle valve when said throttle valve is in a throttle position or positions;

the primary vacuum line coupled between said primary vacuum port and said vacuum chamber of said exhaust gas recirculating valve;

a secondary vacuum port in said air intake such that said secondary vacuum port is upstream from said throttle valve when said throttle valve is in an idle position and downstream from said throttle valve when said throttle valve is in said throttle position or positions;

an engine vacuum operated vacuum control valve having a vacuum chamber, said vacuum control valve allowing air pressure to be applied to said vacuum chamber of said exhaust gas recirculating valve when a vacuum greater than a predetermined magnitude is applied to said vacuum chamber of said vacuum control valve;

a secondary vacuum line coupled between said vacuum chamber of said vacuum control valve and said secondary vacuum port; and a vacuum transmitting valve in said secondary vacuum line, said vacuum transmitting valve delaying in time the application of a vacuum from said secondary vacuum port to said vacuum chamber of said vacuum control valve, and not delaying a change in vacuum from said vacuum control valve to said secondary vacuum port whereby exhaust gas recirculation is allowed for some predetermined time after acceleration of said internal combustion engine occurs.

3. An exhaust gas recirculating control system according to claim 2 further comprising a vacuum surging tank coupled to said secondary vacuum line between said vacuum transmitting valve and said vacuum control valve.

4. An exhaust gas recirculating control system according to claim 2 wherein said vacuum transmitting valve comprises a check valve and an orifice in parallel with said check valve.

5. An exhaust gas recirculating control system according to claim 2 further comprising a throttle positioner coupled to said throttle valve.

* * * * *